United States Patent [19]

Knuth et al.

[11] 4,357,865

[45] Nov. 9, 1982

[54] APPARATUS FOR THE RECOVERY OF OIL FROM OIL-BEARING VEGETABLE MATTER

[75] Inventors: Manfred Knuth; Thorsten Homann, both of Hamburg, Fed. Rep. of Germany

[73] Assignee: Fried. Krupp Gesellschaft mit Beschrankter Haftung, Essen, Fed. Rep. of Germany

[21] Appl. No.: 139,338

[22] Filed: Apr. 11, 1980

[30] Foreign Application Priority Data

Apr. 18, 1979 [DE] Fed. Rep. of Germany ..... 2915538

[51] Int. Cl.[3] ..... B30B 9/14

[52] U.S. Cl. ..... 100/117; 100/37

[58] Field of Search ..... 100/37, 117, 145, 146, 100/147, 148, 149, 150; 366/90

[56] References Cited

U.S. PATENT DOCUMENTS

| | | | |
|---|---|---|---|
| 2,709,957 | 6/1955 | Armstrong | 100/117 |
| 4,024,168 | 5/1977 | Homann et al. | 100/117 X |
| 4,271,754 | 6/1981 | Homann | 100/117 X |

FOREIGN PATENT DOCUMENTS

| | | | |
|---|---|---|---|
| 1070844 | 2/1954 | France | 100/150 |
| 104151 | 4/1924 | Switzerland | 100/150 |
| 800268 | 8/1958 | United Kingdom | 100/117 |
| 1501462 | 2/1978 | United Kingdom | 100/117 |

*Primary Examiner*—Peter Feldman

*Attorney, Agent, or Firm*—Karl F. Ross

[57] ABSTRACT

Apparatus for recovering oil, especially edible oils, from oil-containing fruit and seed in which immediately upon cleaning the fruit and seed, this oil-bearing material is subjected to cold pressing without prior heat treatment to recover a portion of the oil and the residue is thereupon extracted.

The apparatus comprises a worm press formed with a perforated cylinder and a worm rotatable in said cylinder, said worm and said cylinder are subdivided along their lengths into a plurality of sections by respective shear gaps and throttles. The depth of the helical groove between flights progressively decreases toward the shear gaps and, in general, along the worm. The thread depth can range between 2 and 12% of the outer diameter of the worm which is preferably constant over the entire length thereof. Each flight may have a progressively decreasing pitch angle toward the outlet side and can be between 7.5 and 15.

4 Claims, 4 Drawing Figures

APPARATUS FOR THE RECOVERY OF OIL FROM OIL-BEARING VEGETABLE MATTER

FIELD OF THE INVENTION

Our present invention relates to an apparatus for the recovery of oil, especially edible oil, from vegetable matter, namely, oil-bearing fruits and oil-bearing seed.

BACKGROUND OF THE INVENTION

Oil-bearing vegetable matter, especially oil fruits such as olive meat or flesh, and oil-bearing seed such as sesame seed, sunflower seed and soy beans can be cleaned, treated mechanically and thermally, prepressed and finally extracted to recover a large portion of the material oils (edible oils) therefrom.

The mechanical and thermal treatments, known as conditioning are generally carried out in two separate steps. In a first step a precomminution is effected so that the cellular matter which contains the oil is broken down. The apparatus used for this purpose can include fluted or grooved drums or rollers and flaking drums.

The second step follows the mechanical conditioning and involves a thermal treatment in which the vegetable matter is moistened as required, preheated and dried in conditioning drums or heating trays. Only thereafter is the oil-bearing seed or meat prepressed to remove part of the oil, the balance being recovered by the solvent extraction thereafter.

The earlier system not only has the disadvantage that the comminuting devices are subjected to a high degree of wear and in many instances are detrimental to an effective oil recovery, but also that the numerous successive steps require a large transport path for the vegetable matter which in itself may cause deterioration of the product.

Furthermore, the heating devices usually require agitators or turners for the vegetable matter which consume energy and must be continuously monitored so that the plant occupies considerable space and requires attendance of a large staff for effective monitoring.

There have been attempts to overcome these disadvantages. For example, in German patent documents (Printed Application-Auslegeschrift) DE-AS No. 2,335,385 (see U.S. Pat. No. 4,024,168) there is described a process in which the oil-bearing fruit and oil-bearing seed is conditioned in the absence of air thermally and mechanically in a single process step.

For this purpose, a worm or screw press is utilized. Although this system affords a significant energy saving, the overall energy consumption of oil recovery by this process is still excessive, particularly in these days of significant concern for energy conservation.

It has already been proposed to provide direct extraction of the vegetable matter. For example, in German patent document (Open Application-Offenlegungsschrift) DE-OS No. 24 53 911, a prepressing of the oil-bearing material is omitted although, to reach a high degree of oil recovery and a minimal oil content in the residue after extraction, it is necessary to transform the vegetable matter into especially fine flakes. For example, for sunflower seed the subdivision must be three times greater than is otherwise the case. The intermediate products frequently must be moistened and dried during their movement through the system. Furthermore the larger amount of oil increases the subsequent distillation costs and requires a three-fold larger apparatus with three times the energy requirement.

OBJECTS OF THE INVENTION

It is thus the principal object of the present invention to provide an improved apparatus of recovering oil from oil-bearing vegetable matter, e.g. the vegetable matter described in the aforementioned publications, with significantly less energy than heretofore and with a substantially simpler apparatus.

A more specific object of the invention is an apparatus for oil recovery which will yield an especially high quality product and residue.

Yet another object of the invention is to provide a low cost, simply operating, economical and easily monitored apparatus for the recovery oil from oil-bearing vegetable materials.

SUMMARY OF THE INVENTION

These objects and others which will become apparent hereinafer are attained, in accordance with the present invention, in a method of and an apparatus for the recovery of oil in a manner which has low energy consumption and which can use a simple and reliable device to obtain maximum oil recovery and a high quality residue.

According to the invention, the oil-bearing vegetable matter, directly after cleaning (and without any heating or thermal conditioning) is directly prepressed to expel a portion of the trapped oil with the residue being thereafter extracted by solvent extraction techniques. It has been found to be important to the invention that the cold prepressing of the oil-bearing vegetable matter be carried out at a temperature of about 20° C. using a screw-type press. The oil obtained in the pressing operation has a temperature of 30° to 50° C.

Since the system of the invention eliminates completely the mechanical and thermal conditioning heretofore required before pressing, the system has been found to be especially energy conserving and to involve low capital cost.

According to the apparatus aspects of the invention, the prepressing is carried out in a sieve-type worm or screw press, i.e. a screw press in which the worm rotates in a perforated or open work barrel or cylinder, preferably formed by rods or bars extending parallel to the axis of the worm. According to this aspect to the invention, at least one throttle location is provided at which the passage between the worm and the wall of the cylinder is constricted inwardly and each of the throttles forms a shear gap between the worm and the cylinder wall.

According to a feature of the invention, the throttles can be formed from inwardly extending shoulders or annular portions formed on the wall of the cylinder so that the shear gap is provided between the shaft and the annular inward projection directly between flights of the worm to either side of this portion of the shaft.

The depth of the helical groove between flights can progressively decrease toward the shear gaps and, in general along the worm, this decrease in thread depth and hence cross section may be discontinuous. The thread depth can range between 2 and 12% of the outer diameter of the worm which is preferably constant over the entire length thereof and each flight or thread may have a progressively decreasing pitch angle toward the outlet side. Alternatively successive flights, separated by shear gaps, may have pitch angles which are less in the direction of the outlet. The pitch angle can be between 7.5° and 15°.

According to another feature of the invention, the widths of the shear gaps can decrease successively toward the output side of the press, the ratio between the depth of the preceding flight or thread to the succeeding width of the shear gap ranging between 3 and 15.

Stripping fingers may project from the wall of the cylinder and the grooves between the threads and the flights themselves can be interrupted at these locations. Furthermore, it has been found to be advantageous to provide longitudinal grooves at least over the first flight which decreases in depth in the direction of movement of the material.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
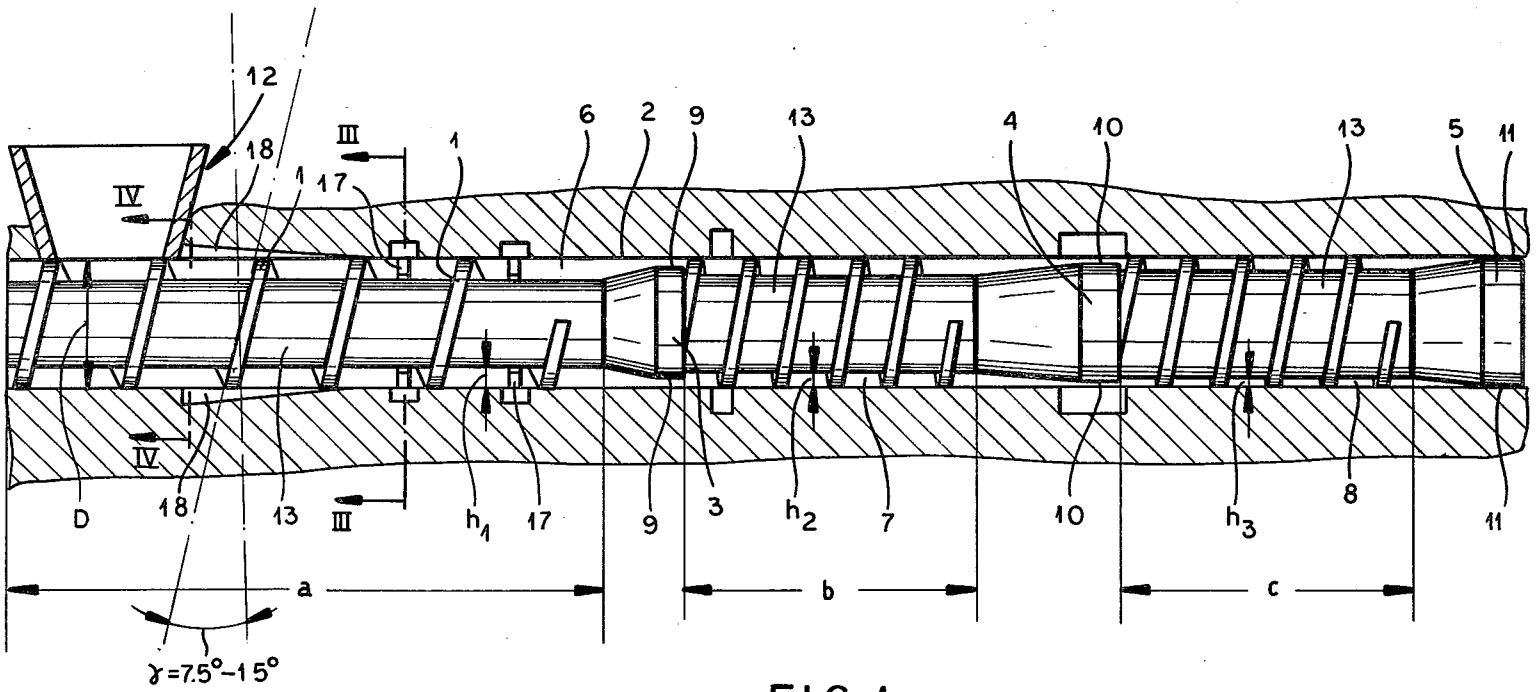
FIG. 1 is a longitudinal cross section diagrammatically illustrating a worm press for the cold prepressing of oil-bearing vegetable matter in accordance with the present invention.

The invention, as will be apparent from the specific example, comprises cold pressing the oil-bearing seed or fruit (oil-bearing vegetable matter) in an initial step without previous mechanical or thermal conditioning and thereafter subjecting the residue to a solvent extraction.

The prepressing can be carried out in a press of the type illustrated in the drawing and comprising a worm 13 rotating in a perforated cylinder 2 and provided with threads or flights 1.

Along the passage formed by the cylinder 2 these are provided throttles 3, 4 and 5 which subdivide the passage into worm passages 6, 7 and 8. The throttles 3, 4 and 5 define shear gaps 9, 10 and 11 between the cylindrical wall and outwardly flaring bosses of the worm. Each shear gap 9, 10 and 11 has a cross section which is smaller than the cross section of the worm passage 6, 7 or 8 upstream thereof in the direction of movement of the material. The pressed oil passes through the openings in the wall of the cylinder (see U.S. Pat. No. 4,024,168) while the residue is discharged axially at the right-hand end for solvent extraction. The throttles 3 through 5 subdivide the length of the worm press into three sections a, b and c which differ in geometry as follows:

In section a the pitch angle of the worm is 15°, the flight height (thread depth) $h_1$ is 12% of the worm diameter D and the ratio of the length of section a to the diameter D is 4.5:1.

The throttle 3 following section a forms a shear gap 9 whose width (radial dimension) is such that it is 1/4.6 of the cross section of flow between successive turns of the flight (having the depth $h_1$).

In section b the pitch angle of the worm is 7.5°, the ratio of the section length to the worm diameter is 2.3:1 and these relationships are the same for section c. However, in section c the root diameter of the shaft is greater so that the cross section $h_2$ in section b is only 10% of the worm diameter D and in section c the depth $h_3$ is 5% of the diameter D.

The throttles 4 and 5 form shear gaps whose radial width is 1/5.75 and 1/6 of the values $h_2$ and $h_3$ of the preceding worm passages 7 and 8, respectively. The worm press ends in an outlet 11 formed by the corresponding shear gap and the throttle 5.

In the region of each throttle 3, 4 or 5 the flight of the worm is either throughgoing or interrupted (the latter being illustrated) and the worm flight can be interrupted at locations at which stripping fingers 17 penetrate radially into the space between turns of the flight. The stripping fingers 17 increase the displacement capacity of the worm by reducing the tendency of the material to be recirculated within a zone by the worm.

The stripping fingers can also be so dimensioned as to further comminute the material.

Figure 2:
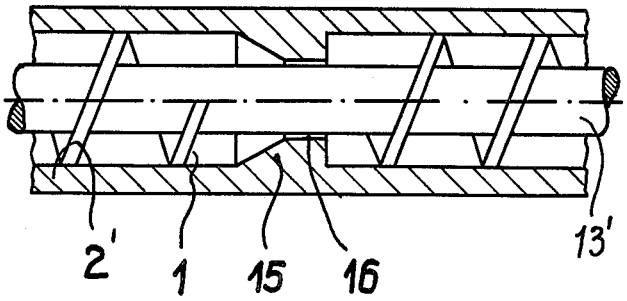
FIG. 2 is a portion of another worm press illustrating an alternative to the construction shown of the throttle gap in FIG. 1.

While the throttles in FIG. 1 are formed by enlargements on the worm, the worm shaft 13' (FIG. 2) can have a constant diameter or, in any event, a smaller diameter, with each throttle gap 16 being formed by an inward projection 15 from the cylinder wall 2'. In this case, the flank of the inwardly projecting shoulder 15 converges frustoconically inwardly.

Figure 3:
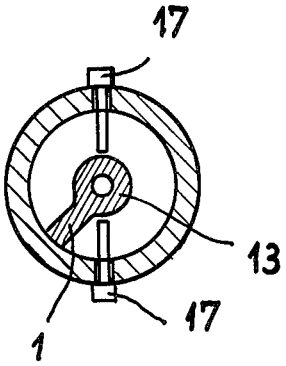
FIG. 3 is a cross-sectional view taken along the line III—III of FIG. 1.
Figure 4:
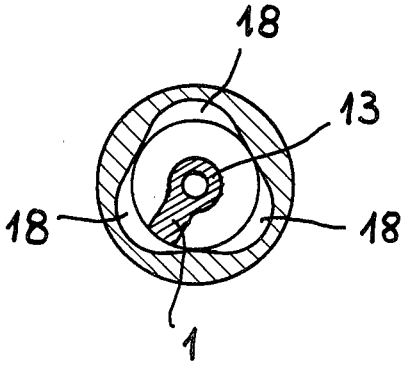
FIG. 4 is a section taken along the line IV—IV of FIG. 1.

FIG. 3 shows that the stripping fingers project radially into the cylinder at 17 while FIG. 4 shows an advantageous embodiment in which the region of the funnel inlet 13 of the cylinder 2 can be formed with a polygonal profile defined by grooves 18 which are angularly equispaced and increase progressively in depth in the direction of movement of the material to the right.

SPECIFIC EXAMPLE

The press shown in FIG. 1 was used with throughputs of 300 to 500 kg in succession of rape, linseed and sunflower seed and produces press cakes an oil content of 13 to 25% by weight. The residue is extracted as press cake in an extractor for 50, 100 and 150 minutes (see the aforementioned U.S. patent) and the results are compared with a conventional method involving breaking, rolling, thermal conditioning, prepressing and extraction using identical quantities of seed.

Table 1 shows the quality evaluation of the oil recovered from rape seed.

TABLE 1

| Quality Characteristics | Oil produced by Conventional Process | Process of the Invention |
|---|---|---|
| Peroxide value | 1 | 0.4 |
| Anisidine value | 1.1 | 0.7 |
| Total Phosphorous in crude oil | 175 ppm | 71 ppm |
| Phosphorus content in deslimed oil | 145 ppm | 59 ppm |
| Chlorophyll | 17 ppm | 7 ppm |
| Color according to Lovibond | 175 | 155 |

From this table it can be seen that the oil of the invention is of much higher quality than that which results from the conventional process.

Table 2 shows the residual oil content of the press cake as a function of extraction time with the system of the invention and the conventional process.

TABLE 2

| | Known Process | | | Process of the Invention | | |
|---|---|---|---|---|---|---|
| | Residual Oil Content Reffered to Dry Substance | | | | | |
| | Weight % | | | Weight % | | |
| Extraction Time (min.) | Rape | Linseed | Sun-flower | Rape | Linseed | Sun-flower |
| 50 | 2.1 | — | 2.2 | 1.2 | 0.7 | 1.5 |
| 100 | 1.4 | — | 1.5 | 0.85 | 0.4 | 0.9 |
| 150 | 1.2 | — | 1.3 | 0.7 | 0.3 | 0.6 |

Table 3 below shows other advantages of the invention apart from the lesser investment cost, e.g. by illustrating the energy consumption for the various process steps of the earlier system and that of the invention. The mechanical pressing utilizes approximately the same amount of electricity and substantially less steam energy than heretofore. The middle columns of the table show a direct extraction without prepressing after rolling and conditioning.

TABLE 3

| | Conventional Process | | Direct Extraction | | Process of the Invention | |
|---|---|---|---|---|---|---|
| Process Step | Electrical Energy Consump. | Steam Comsumption | Electrical Energy Consump. | Steam Consumption | Electrical Energy Consump. | Steam Consumption |
| Rolling | 20 | — | 80 | — | — | — |
| Heating Structuring | 5 | 60 | 5 | 82 | — | — |
| Prepressing | 20 | — | — | — | 50 | — |
| Extraction/Distillation | 1 | 50 | 1 | 150 | 1 | 50 |
| Total | 46 | 110 | 86 | 232 | 51 | 50 |

We claim:

1. An apparatus for cold pressing vegetable oil bearing matter without intervening mechanical or thermal conditioning, which comprises a worm press formed with a perforated cylinder and a worm rotatable in said cylinder, said worm defining with a wall of said cylinder downstream, at least one throttle forming a shear gap having a cross section smaller than the cross section between successive turns of a flight of the worm, said worm and said cylinder being subdivided along their lengths into a plurality of sections by respective shear gaps and throttles with an initial section having a worm length to diameter ratio of about 4.5:1 and a subsequent section having a worm length to diameter ratio of about 2.3:1, each of said throttles being defined by an inwardly projecting portion from the wall of said cylinder, said flight being interrupted over the length of said press, the depth of the passage formed between successive turns of said flight being substantially 2 to 12% of the diameter of said worm, wherein the pitch angle of said worm is between substantially 7.5° and 15° and decreases between an upstream end of said worm and downstream thereof in the direction of material advance through said press, and wherein the widths of said gaps decrease in the downstream direction, the ratio of the depth of the passage between turns of said flight and the radial width of a gap downstream thereof being between substantially 3 and 15.

2. The apparatus defined in claim 1, further comprising stripping fingers projecting radially inwardly from said cylinder, said flight being interrupted in the regions of said stripping fingers.

3. The apparatus defined in claim 1 wherein the first section of said cylinder has a polygonal cross section and is formed with longitudinal grooves extending in the direction of movement of the material through said press.

4. The apparatus defined in claim 3 wherein said grooves are of progressively decreasing depth in said direction.

* * * * *